US009226640B1

(12) United States Patent
Wulff

(10) Patent No.: US 9,226,640 B1
(45) Date of Patent: Jan. 5, 2016

(54) MOP TROLLEY WITH A CENTRAL MOP SPRAYER AND MOP REST

(71) Applicant: Kai Wulff, Brownsville, TX (US)

(72) Inventor: Kai Wulff, Brownsville, TX (US)

( * ) Notice: Subject to any disclaimer, the term of this patent is extended or adjusted under 35 U.S.C. 154(b) by 0 days.

(21) Appl. No.: 14/826,841

(22) Filed: Aug. 14, 2015

(51) Int. Cl.
*A47L 13/50* (2006.01)
*A47L 13/58* (2006.01)

(52) U.S. Cl.
CPC *A47L 13/50* (2013.01); *A47L 13/58* (2013.01)

(58) Field of Classification Search
CPC ..... A47L 13/50; A47L 13/58
See application file for complete search history.

(56) References Cited

U.S. PATENT DOCUMENTS 1,767,840 A * 6/1930 Finnell ..... A47L 13/58 15/264
2,321,981 A * 6/1943 Bowers ..... A47J 47/18 15/264
3,045,252 A * 7/1962 Sorrells ..... A47L 13/50 4/626
3,101,088 A * 8/1963 Gray ..... A47L 13/50 134/151
4,161,799 A * 7/1979 Sorrells ..... A47L 13/58 15/260
4,798,307 A 1/1989 Evrard
6,279,195 B1 * 8/2001 Biggs ..... A47L 13/59 15/260
6,976,286 B1 12/2005 Sanabria
8,381,931 B1 * 2/2013 Ernest, III ..... B62B 1/264 206/518
8,696,028 B2 4/2014 Nelson

* cited by examiner

*Primary Examiner* — Randall Chin
(74) *Attorney, Agent, or Firm* — Crossley Patent Law

(57) ABSTRACT

A mop trolley with a central mop sprayer and mop rest including a wheeled U-shaped base and a continuous recess therein, a pair of removable buckets atop the recess, and an upright support between the buckets. A manually-operable liquid pump assembly between the buckets includes a pump housing containing a pump operated by a pump lever which pumps liquid from an inlet hose in one bucket through a water outlet tube having liquid jet dispensers therealong which, in turn, spray onto a mop cleaning end resting on a mesh tray positioned between the pump housing and the upright support. The mesh tray has openings through which the water used to clean the mop is dispensed into the other bucket. A mop rest hook, disposed on an underside of a cross-member support that supports the liquid jet dispensers, supports a handle of the mop situated on the mesh tray.

9 Claims, 6 Drawing Sheets

MOP TROLLEY WITH A CENTRAL MOP SPRAYER AND MOP REST

BACKGROUND OF THE INVENTION

Various types of janitorial trolleys, including mop buckets, are known in the prior art. However, what is needed is a mop trolley with a central mop sprayer and mop rest including a wheeled U-shaped base, a continuous recess therein, and a first bucket and a second bucket removably disposed atop the recess. An upright support is disposed between the first and second buckets. A manually-operable liquid pump assembly between the first and second buckets includes a pump housing containing a pump operated by a pump lever which pumps liquid from an inlet hose in the first bucket and through a water outlet tube having liquid jet dispensers disposed therealong. The liquid jet dispensers, in turn, spray onto a mop cleaning end resting on a mesh tray positioned between the pump housing and the upright support. The pump lever also moves the mesh tray from a lowered position to a raised position to move the mesh tray closer to the liquid jet dispensers to press the mop cleaning end against the liquid jet dispensers and to force liquid through the mop cleaning end and vice versa. The mesh tray has openings through which the water from the first bucket used to clean the mop is dispensed into the second bucket. A mop rest hook, disposed on an underside of a cross-member support that supports the liquid jet dispensers, supports a handle of the mop situated on the mesh tray.

FIELD OF THE INVENTION

The present invention relates to utility buckets, and more particularly, to a mop trolley with a central mop sprayer and mop rest.

SUMMARY OF THE INVENTION

The general purpose of the present mop trolley with a central mop sprayer and mop rest, described subsequently in greater detail, is to provide a mop trolley with a central mop sprayer and mop rest which has many novel features that result in a mop trolley with a central mop sprayer and mop rest which is not anticipated, rendered obvious, suggested, or even implied by prior art, either alone or in combination thereof.

To accomplish this, the present mop trolley with a central mop sprayer and mop rest includes a wheeled U-shaped base and a continuous recess therein. A first bucket and a second bucket are removably disposed atop the recess. An upright support is disposed between the first and second buckets. A manually-operable liquid pump assembly is disposed between the first and second buckets. The liquid pump assembly includes a pump housing containing a pump operated by a pump lever which pumps liquid from an inlet hose in the first bucket and through a water outlet tube having liquid jet dispensers disposed therealong. The liquid jet dispensers, in turn, spray onto a mop cleaning end resting on a mesh tray positioned between the pump housing and the upright support. The pump lever also moves the mesh tray from a lowered position to a raised position to move the mesh tray closer to the liquid jet dispensers and vice versa. The mesh tray has openings through which the water from the first bucket used to clean the mop is dispensed into the second bucket. A mop rest hook, disposed on an underside of a cross-member support that supports the liquid jet dispensers, supports a handle of the mop situated on the mesh tray.

Thus has been broadly outlined the more important features of the present mop trolley with a central mop sprayer and mop rest so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
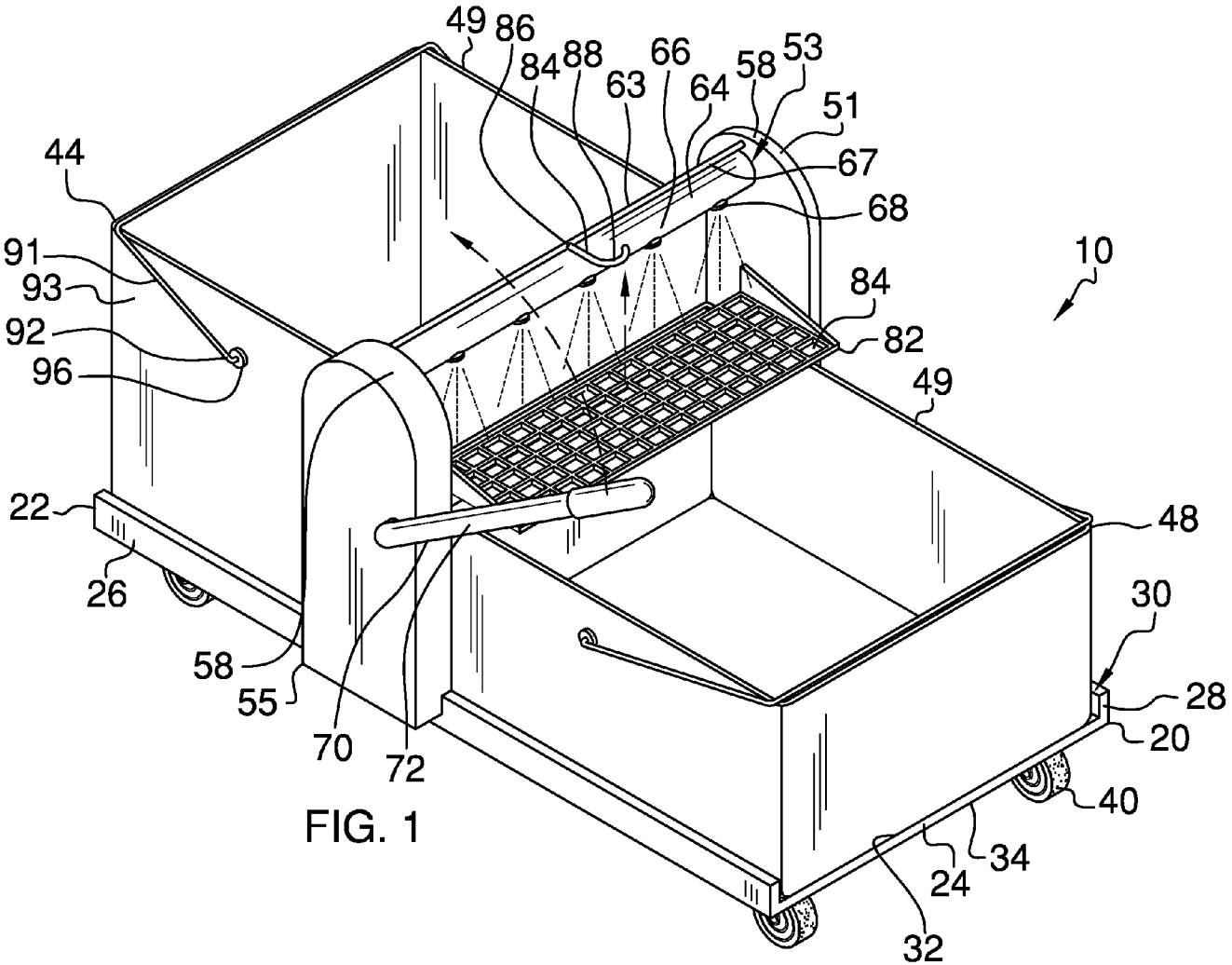
FIG. 1 is an isometric view.
Figure 2:
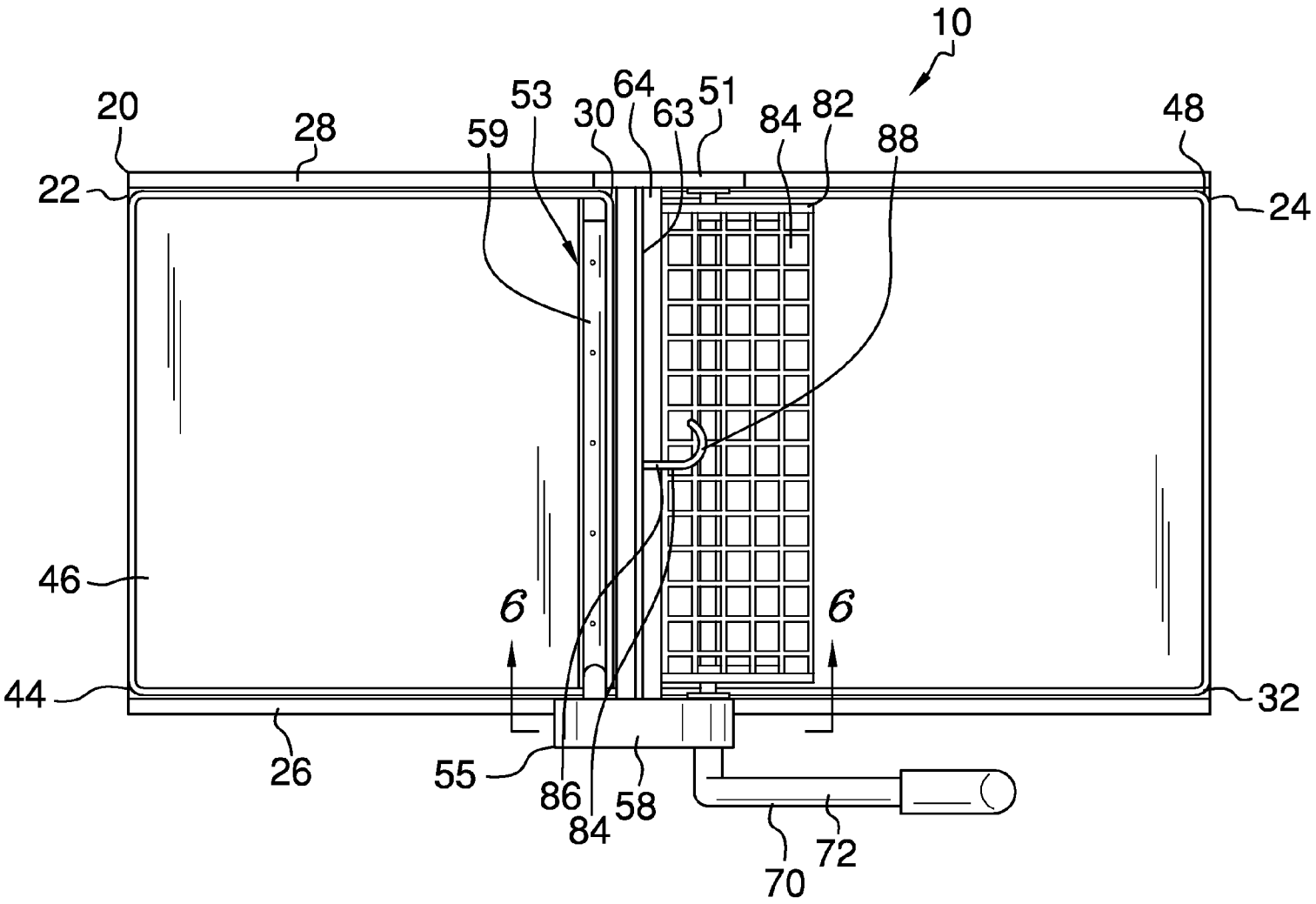
FIG. 2 is a top plan view.

With reference now to the drawings, and in particular FIGS. 1 through 6 thereof, an example of the instant mop trolley with a central mop sprayer and mop rest employing the principles and concepts of the present mop trolley with a central mop sprayer and mop rest and generally designated by the reference number 10 will be described.

Referring to FIGS. 1 through 6 the present mop trolley with a central mop sprayer and mop rest 10 is illustrated. The mop trolley with a central mop sprayer and mop rest 10 includes a U-shaped base 20 having a front end 22, a back end 24, a vertical right side 26, a vertical left side 28, and a recess 30 continuously disposed between the front end 22, the back end 24, the right side 26, and the left side 28. The recess 30 has a flat top side 32 and a flat bottom side 34. A plurality of wheels 40, such as caster wheels, is disposed on the bottom side 34.

Figure 3:
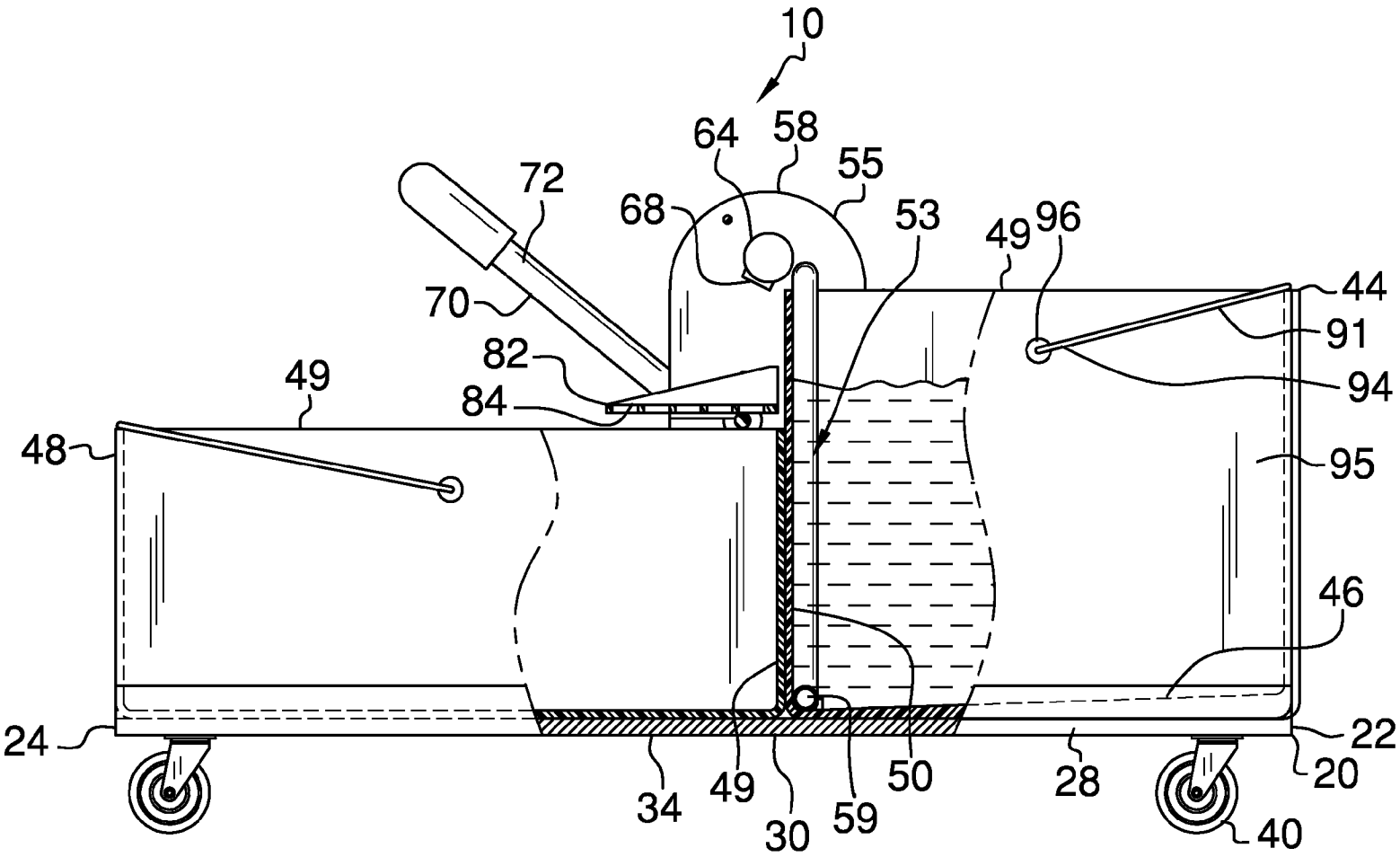
FIG. 3 is a left side elevation view showing a pump lever and a mesh screen in a lowered position.
Figure 4:
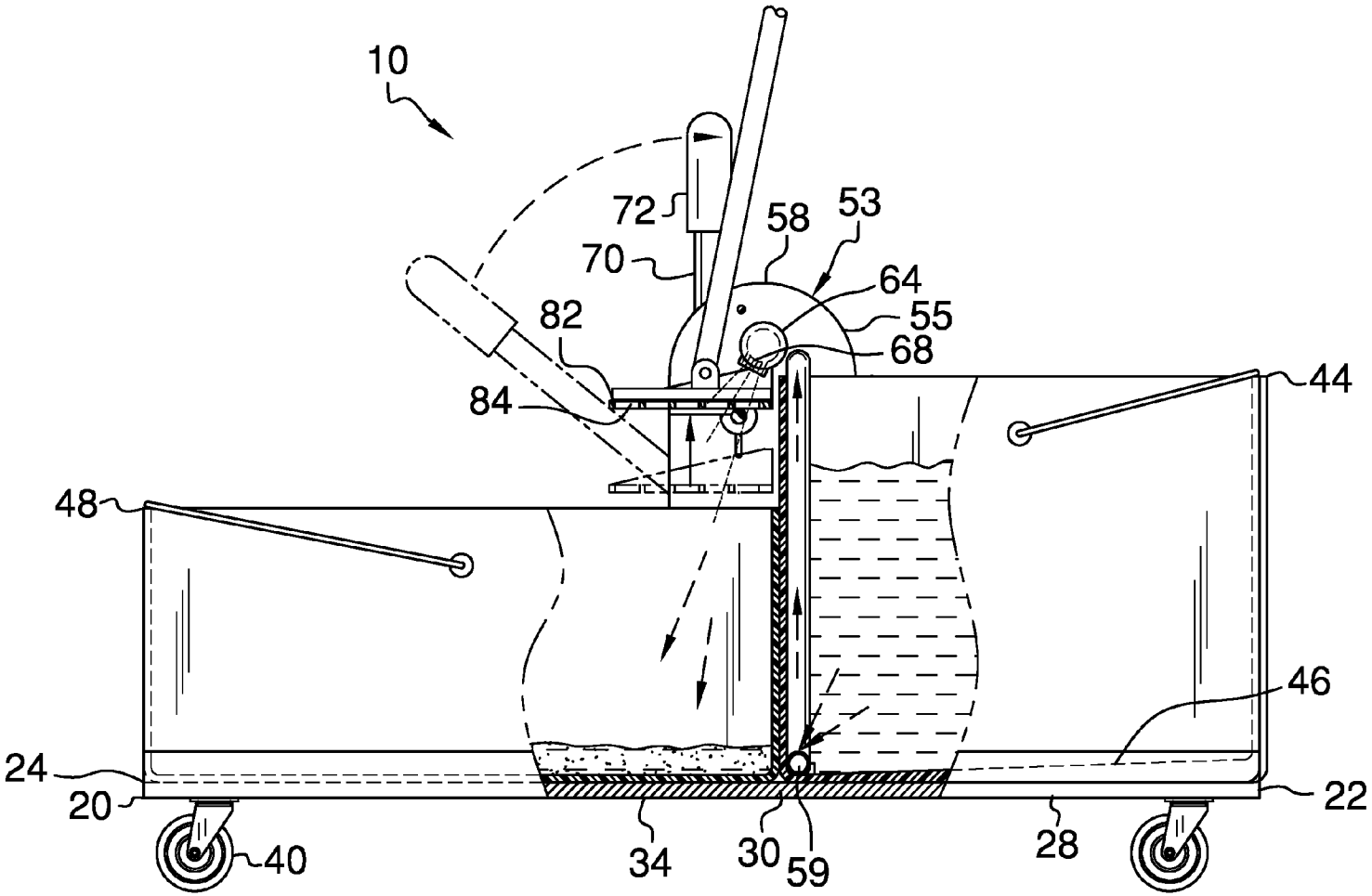
FIG. 4 is a left side elevation view showing the pump lever and the mesh screen in a raised position.
Figure 5:
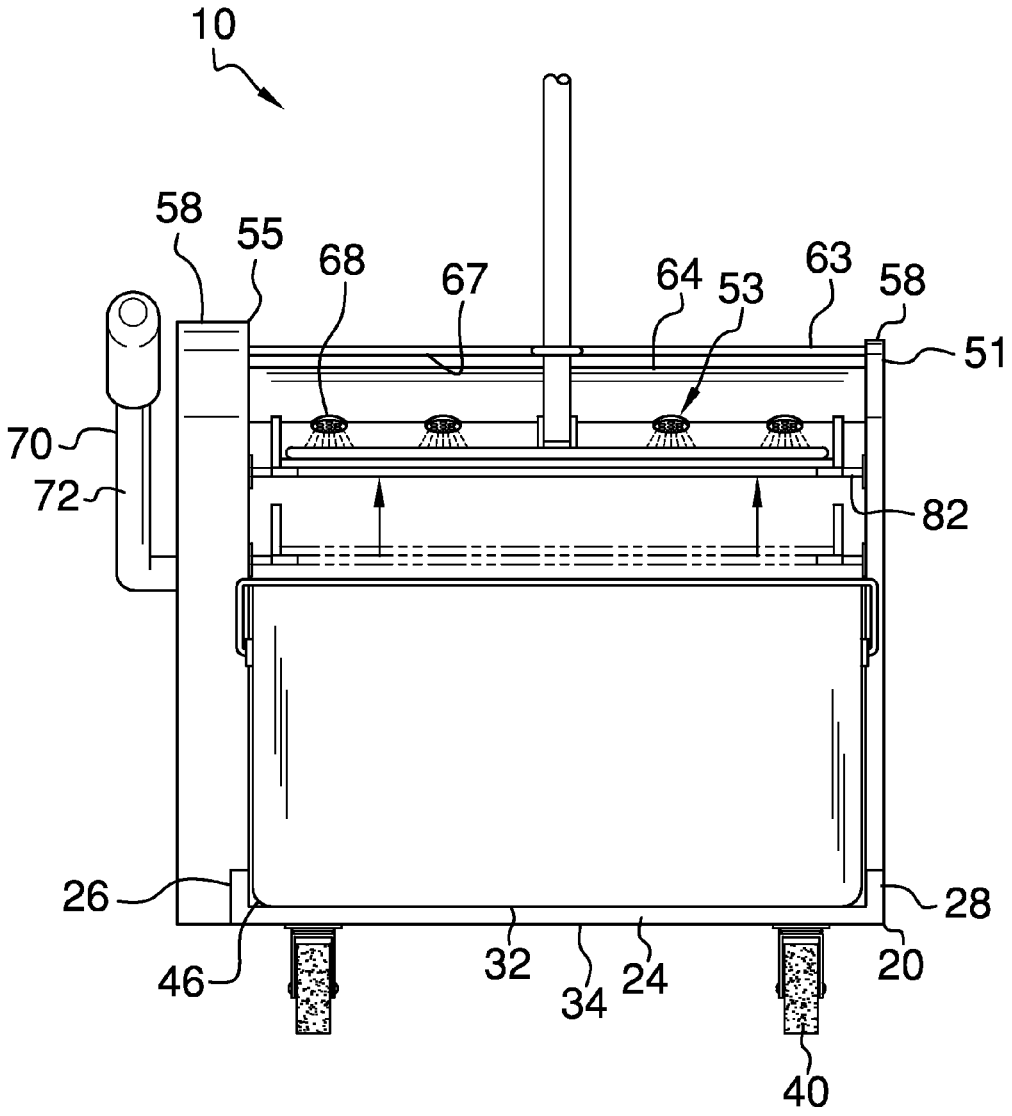
FIG. 5 is a front elevation view showing the pump lever and the mesh screen in a raised position.
Figure 6:
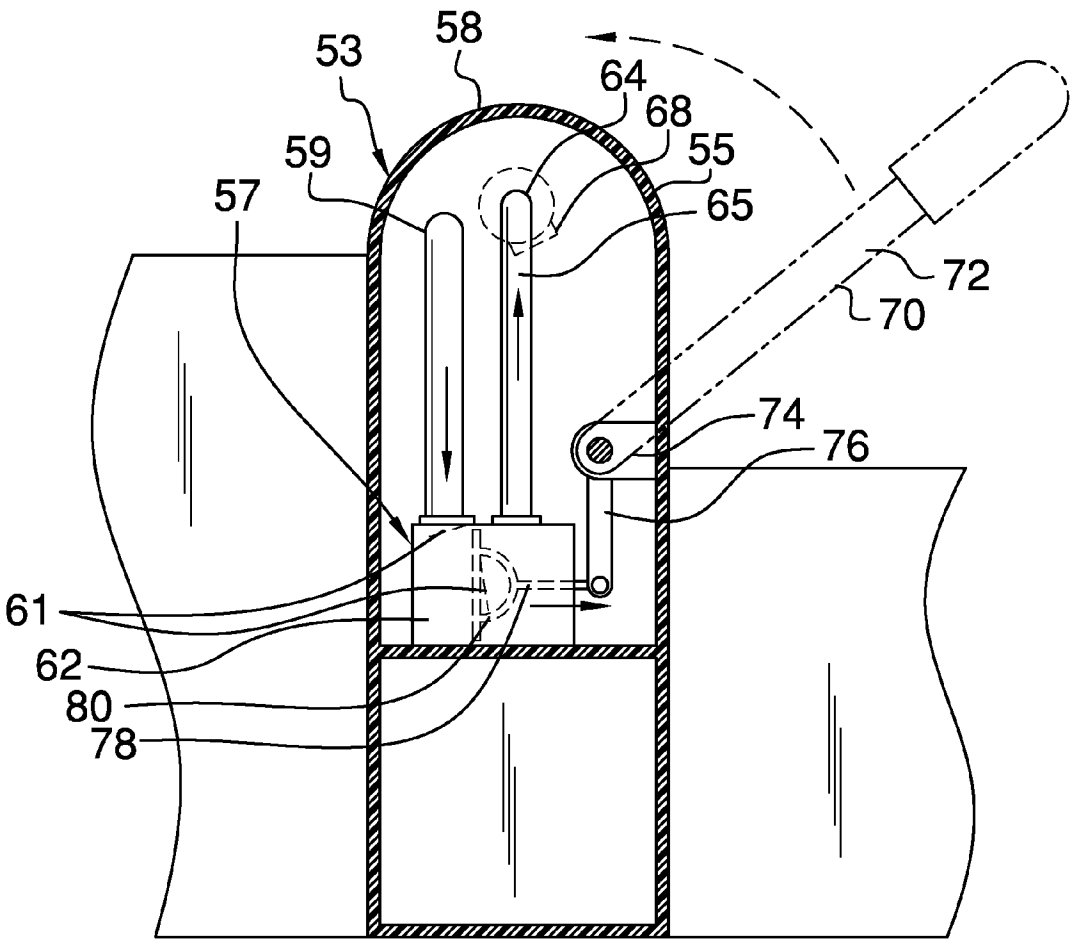
FIG. 6 is a cross-sectional view taken along line 6-6 of FIG. 2.

A removable first bucket 44 is continuously disposed within the recess 30 top side 32. The first bucket 44 has a continuously sloped bottom floor 46 to maximize removal of an amount of liquid, such as water, contained within the first bucket 44 to be drained therefrom. A removable second bucket 48 is continuously disposed within the recess 30. Each of the first bucket 44 and the second bucket 48 has an upper side 49 and further has a width across an entire width of the recess 30. Each of the first bucket 44 and the second bucket 48 terminates at the front end 22 and the back end 24 of the base 20, respectively, and abut each other at an internal wall 50 of each of the first and second buckets 44, 48, as best shown in FIGS. 3 and 4. The first bucket 44 has a depth greater than a depth of the second bucket 48.

An upright support 51 is disposed on the base 20 between the first bucket 44 and the second bucket 48. A manually-operable liquid pump assembly 53 is disposed on the base 20 between the first bucket 44 and the second bucket 48. The liquid pump assembly 53 includes a pump housing 55 disposed on one of the right side 26 and the left side 28 of the base 20 between the first bucket 44 and the second bucket 48 and a manually-operable lever-actuated liquid pump 57 disposed within the pump housing 55. A water inlet hose 59 is continuously disposed between the bottom floor 46 of the first bucket 44 proximal the pump 57 and a check valve 61 disposed on a pump cylinder 62 of the pump 57.

A cross-member support 63 is continuously disposed between the upright support 51 and the pump housing 55 proximal a top end 58 of each of the upright support 51 and the pump housing 55. A hollow water outlet tube 64 has an interior portion 65 in fluid communication with the pump 57 and an exterior portion 66 continuously disposed on an underside 67 of the cross-member support 64. The water outlet tube 64 has a plurality of spaced apart liquid jet dispensers 68 disposed along the exterior portion 66. The water inlet hose 59, the pump 57, the water outlet tube 64, and the liquid jet dispensers 68 are in fluid communication with each other. The upper side 49 of the first bucket 44 is disposed proximal the liquid jet dispensers 68 to assist in directing liquid being disposed from the liquid jet dispensers 68 toward the second bucket 48 while assisting in preventing spillage of the liquid.

The liquid pump assembly 53 also includes a pivotable pump lever 70 having a handle 72 exteriorly disposed on the pump housing 55, an interior end 74 disposed on the handle 72 within the pump housing 55, an arm 76 rotationally extending from the interior end 74, and a piston rod 78 rotationally extending between the arm 76 and a piston 80 in operational communication with the pump cylinder 62.

A mesh tray 82 is continuously disposed between the pump housing 55 and the upright support 51 in a position between the water outlet tube 64 and the upper side 49 of the second bucket 48. The mesh tray 82 has a plurality of openings 84 continuously disposed therein. The pump lever 70 is in operational communication with the mesh tray 82. The pump lever 70 pivots from a lowered position with the handle 72 being disposed proximal the upper side 49 of the second bucket 48 to a raised position with the handle 72 being disposed proximal an upper end 86 of the pump housing 55 to draw the amount of water from the first bucket 44 through the water inlet hose 59 and the pump 57, and further through the water outlet tube 64 and the liquid jet dispensers 68, through a cleaning end of the mop and the mesh tray 82, and from the mesh tray 82 into the second bucket 48. The mesh tray 82 is configured to support a mop atop thereof and to press the mop cleaning end against the water outlet tube 64 exterior portion 66 to clean the mop by forcing the water from the liquid jet dispensers 68 through the mop cleaning end. The mesh tray openings 84 permit the water used from the first bucket 44 while cleaning a cleaning end of the mop to flow through the mop cleaning end and into the second bucket 48.

A mop rest hook 84 is disposed on the underside 67 of the cross-member support 63. The mop rest hook 84 has a proximal end 86 centrally disposed on the cross-member support 63 in a position perpendicular to the cross-member support 63 and parallel to the mesh tray 82 and a U-shaped distal end 88 directed toward the cross-member support 63. The distal end 88 disposed in a position directly above the mesh tray 82. The mop rest hook 84 is thus configured and provided to support a mop handle of the mop in an upright position and perpendicular to the cross-member support 63.

A bucket handle 91 is rotationally disposed on each of the first and second buckets 44, 48. Each bucket handle 91 has a first end 92 disposed on a right wall 93 and a second end 94 disposed on a left wall 95 of the respective first and second buckets 44, 48. The bucket handle 91 assists in handling the first and second buckets 44, 48 when seating them in and removing them from the recess 30.

A reinforcement member 96 is disposed on each of the right and left walls 93, 95 of each of the first and second buckets 44, 48. Each of the first end 92 and the second end 94 of each bucket handle 91 is disposed within the respective reinforcement member 96. Each reinforcement member 96 is configured to strengthen the attachment of the first and second ends 92, 94 to the respective first and second buckets 44, 48.

What is claimed is:

1. A mop trolley with a central mop sprayer and mop rest comprising:

a U-shaped base having a front end, a back end, a vertical right side, a vertical left side, and a recess continuously disposed between the front end, the back end, the right side, and the left side, the recess having a flat top side and a flat bottom side;

a plurality of wheels disposed on the bottom side;

a removable first bucket continuously disposed within the recess top side, the first bucket having a continuously sloped bottom floor;

a removable second bucket continuously disposed within the recess, each of the first bucket and the second bucket having an upper side and further having a width across an entire width of the recess, each of the first bucket and the second bucket terminating at the front end and the back end of the base, respectively and abutting each other at an internal wall of each of the first and second buckets;

an upright support disposed on the base between the first bucket and the second bucket;

a manually-operable liquid pump assembly disposed on the base between the first bucket and the second bucket, the liquid pump assembly including:

a pump housing disposed on one of the right side and the left side of the base between the first bucket and the second bucket;

a manually-operable lever-actuated liquid pump disposed within the pump housing;

a water inlet hose continuously disposed between the bottom floor of the first bucket proximal the pump and a check valve disposed on a pump cylinder of the pump;

a cross-member support continuously disposed between the upright support and the pump housing proximal a top end of each of the upright support and the pump housing;

a hollow water outlet tube having an interior portion in fluid communication with the pump and an exterior portion continuously disposed on an underside of the cross-member support, the water outlet tube having a plurality of spaced apart liquid jet dispensers disposed along the exterior portion, wherein the water inlet hose, the pump, the water outlet tube, and the liquid jet dispensers being in fluid communication with each other;

a pivotable pump lever having a handle exteriorly disposed on the pump housing, an interior end disposed on the handle within the pump housing, an arm rotationally extending from the interior end, and a piston rod rotationally extending between the arm and a piston in operational communication with the pump cylinder;

a mesh tray continuously disposed between the pump housing and the upright support in a position between the water outlet tube and the upper side of the second bucket, the mesh tray having a plurality of openings continuously disposed therein, the pump lever being in operational communication with the mesh tray, wherein the pivoting of the pump lever from a lowered position with the handle being disposed proximal the upper side of the second bucket to a raised position with the handle being disposed proximal an upper end of the pump housing is configured to draw the amount of water from the first bucket through the water inlet hose and the pump, and further through the water outlet tube and the liquid jet dispensers, through a cleaning end of a mop and the mesh tray, and from the mesh tray into the second bucket; and wherein the mesh tray is configured to support the mop atop thereof.

2. The mop trolley with a central mop sprayer and mop rest of claim 1 further comprising:

a mop rest hook disposed on the underside of the cross-member support; and the mop rest hook having a proximal end centrally disposed on the cross-member support in a position perpendicular to the cross-member support and parallel to the mesh tray and a U-shaped distal end directed toward the cross-member support, the distal end disposed in a position directly above the mesh tray;

wherein the mop rest hook is configured to support a mop handle of the mop in an upright position and perpendicular to the cross-member support.

3. The mop trolley with a central mop sprayer and mop rest of claim 1:

wherein the first bucket has a depth greater than a depth of the second bucket; and wherein the upper side of the first bucket is disposed proximal the liquid jet dispensers.

4. The mop trolley with a central mop sprayer and mop rest of claim 1 wherein the plurality of wheels is a pair of caster wheels disposed proximal each of the front side and the rear side on each of the right and left sides.

5. The mop trolley with a central mop sprayer and mop rest of claim 1 further comprising:

a bucket handle rotationally disposed on each of the first and second buckets, each bucket handle having a first end disposed on a right wall and a second end disposed on a left wall of the respective first and second buckets.

6. The mop trolley with a central mop sprayer and mop rest of claim 5 further comprising a reinforcement member disposed on each of the right and left walls of each of the first and second bucket, each of the first end and the second end of each bucket handle being disposed within the respective reinforcement member, each reinforcement member configured to strengthen the attachment of the first and second ends to the respective first and second buckets.

7. A mop trolley with a central mop sprayer and mop rest comprising:

a U-shaped base having a front end, a back end, a vertical right side, a vertical left side, and a recess continuously disposed between the front end, the back end, the right side, and the left side, the recess having a flat top side and a flat bottom side;

a plurality of caster wheels disposed on the bottom side;

a removable first bucket continuously disposed within the recess top side, the first bucket having a continuously sloped bottom floor;

a removable second bucket continuously disposed within the recess, each of the first bucket and the second bucket having an upper side and further having a width across an entire width of the recess, each of the first bucket and the second bucket terminating at the front end and the back end of the base, respectively and abutting each other at an internal wall of each of the first and second buckets;

an upright support disposed on the base between the first bucket and the second bucket;

a manually-operable liquid pump assembly disposed on the base between the first bucket and the second bucket, the liquid pump assembly including:

a pump housing disposed on one of the right side and the left side of the base between the first bucket and the second bucket;

a manually-operable lever-actuated liquid pump disposed within the pump housing;

a water inlet hose continuously disposed between the bottom floor of the first bucket proximal the pump and a check valve disposed on a pump cylinder of the pump;

a cross-member support continuously disposed between the upright support and the pump housing proximal a top end of each of the upright support and the pump housing;

a hollow water outlet tube having an interior portion in fluid communication with the pump and an exterior portion continuously disposed on an underside of the cross-member support, the water outlet tube having a plurality of spaced apart liquid jet dispensers disposed along the exterior portion, wherein the water inlet hose, the pump, the water outlet tube, and the liquid jet dispensers being in fluid communication with each other;

a pivotable pump lever having a handle exteriorly disposed on the pump housing, an interior end disposed on the handle within the pump housing, an arm rotationally extending from the interior end, and a piston rod rotationally extending between the arm and a piston in operational communication with the pump cylinder;

a mesh tray continuously disposed between the pump housing and the upright support in a position between the water outlet tube and the upper side of the second bucket, the mesh tray having a plurality of openings continuously disposed therein, the pump lever being in operational communication with the mesh tray, wherein the pivoting of the pump lever from a lowered position with the handle being disposed proximal the upper side of the second bucket to a raised position with the handle being disposed proximal an upper end of the pump housing is configured to draw the amount of water from the first bucket through the water inlet hose and the pump, and further through the water outlet tube and the liquid jet dispensers, through a cleaning end of a mop and the mesh tray, and from the mesh tray into the second bucket;

wherein the mesh tray is configured to support the mop atop thereof;

a mop rest hook disposed on the underside of the cross-member support;

the mop rest hook having a proximal end centrally disposed on the cross-member support in a position perpendicular to the cross-member support and parallel to the mesh tray and a U-shaped distal end directed toward the cross-member support, the distal end disposed in a position directly above the mesh tray;

wherein the mop rest hook is configured to support a mop handle of the mop in an upright position and perpendicular to the cross-member support;

wherein the first bucket has a depth greater than a depth of the second bucket;

wherein the upper side of the first bucket is disposed proximal the liquid jet dispensers; and a bucket handle rotationally disposed on each of the first and second buckets, each bucket handle having a first end disposed on a right wall and a second end disposed on a left wall of the respective first and second buckets.

8. The mop trolley with a central mop sprayer and mop rest of claim 7 further comprising a reinforcement member disposed on each of the right and left walls of each of the first and second buckets, each of the first end and the second end of each bucket handle being disposed within the respective reinforcement member, each reinforcement member configured to strengthen the attachment of the first and second ends to the respective first and second buckets.

9. The mop trolley with a central mop sprayer and mop rest of claim 8 wherein a pair of the caster wheels is disposed proximal each of the front side and the rear side on each of the right and left sides.

* * * * *